US010668326B2

(12) United States Patent
Chiang

(10) Patent No.: US 10,668,326 B2
(45) Date of Patent: Jun. 2, 2020

(54) SWIMMING GOGGLES

(71) Applicant: Global Esprit Inc., New Taipei (TW)

(72) Inventor: Herman Chiang, New Taipei (TW)

( * ) Notice: Subject to any disclaimer, the term of this patent is extended or adjusted under 35 U.S.C. 154(b) by 258 days.

(21) Appl. No.: 15/814,396

(22) Filed: Nov. 16, 2017

(65) Prior Publication Data

US 2019/0070464 A1 Mar. 7, 2019

(30) Foreign Application Priority Data

Sep. 7, 2017 (TW) ..... 106213306 U

(51) Int. Cl.
*A63B 33/00* (2006.01)

(52) U.S. Cl.
CPC ..... *A63B 33/002* (2013.01); *A63B 2033/004* (2013.01); *A63B 2210/50* (2013.01)

(58) Field of Classification Search
CPC ..... A63B 33/002; A63B 2033/004; A63B 2210/50
See application file for complete search history.

(56) References Cited

U.S. PATENT DOCUMENTS 8,117,680 B1 * 2/2012 Chou ..... A63B 33/002 2/450
D831,100 S * 10/2018 Chiang ..... D16/311
2011/0191948 A1 * 8/2011 Chiang ..... A63B 33/002 2/440
2011/0219523 A1 * 9/2011 Chiang ..... A63B 33/002 2/434
2011/0258761 A1 * 10/2011 Chou ..... A63B 33/002 2/445
2011/0271432 A1 * 11/2011 Chiang ..... A63B 33/002 2/440
2011/0302702 A1 * 12/2011 Chiang ..... A63B 33/002 2/442
2012/0160989 A1 * 6/2012 Yasuhara ..... A63B 33/002 248/693
2012/0246810 A1 * 10/2012 Chiang ..... A63B 33/002 2/428
2013/0055489 A1 * 3/2013 Shiue ..... A63B 33/002 2/428
2013/0239306 A1 * 9/2013 Chiang ..... A63B 33/00 2/442
2013/0269088 A1 * 10/2013 Chiang ..... A63B 33/002 2/431
2013/0283509 A1 * 10/2013 Chiang ..... A63B 33/002 2/442

(Continued)

*Primary Examiner* — Richale L Quinn

(57) ABSTRACT

Swimming goggles in accordance with the present invention comprises a first lens frame, a second lens frame, and a connection element, characterized in that: each of the first lens frame and the second lens frame is composed of a lens portion, a protective pad, and a frame portion. The lens portion comprises a lens, a peripheral surface, a circular groove, a positioning flange, and an embedding groove. The protective pad comprises a circular body, a face contact circumference, and a circular lip. The frame portion comprises a hard frame body and a soft frame foot. Therefore, the swimming goggles provide a wearer to select the first and second lens frames by free match for favorite colors and suitable degrees of myopia, as being a customized assembly, and provide a fit to a temple of an outline of the wearer for wearing comfort, water resistance reduction, and waterproof.

9 Claims, 4 Drawing Sheets

(56) References Cited

U.S. PATENT DOCUMENTS

| | | | | |
|---|---|---|---|---|
| 2014/0283288 | A1* | 9/2014 | Chiang | A63B 33/002 2/431 |
| 2014/0331395 | A1* | 11/2014 | Chiang | A63B 33/002 2/442 |
| 2014/0345038 | A1* | 11/2014 | Chiang | A63B 33/002 2/442 |
| 2014/0359923 | A1* | 12/2014 | Chiang | A63B 33/002 2/442 |
| 2015/0128385 | A1* | 5/2015 | Kuo | A44B 11/006 24/193 |
| 2015/0143619 | A1* | 5/2015 | Cross | A63B 33/002 2/427 |
| 2015/0335956 | A1* | 11/2015 | DiChiara | A63B 33/002 351/43 |
| 2016/0016047 | A1* | 1/2016 | Chiang | A63B 33/002 2/440 |
| 2017/0203159 | A1* | 7/2017 | Schuwerk | A63B 33/002 |
| 2018/0339197 | A1* | 11/2018 | Chiang | A63B 71/10 |
| 2019/0146240 | A1* | 5/2019 | Chen | G02C 5/02 351/43 |

* cited by examiner

SWIMMING GOGGLES

BACKGROUND OF THE INVENTION

1. Field of the Invention

The present invention relates generally to swimming goggles, and in particular to swimming goggles which bring in convenience in assembly and disassembly thereof, and benefit a selection on lens frames by free match for desired colors and suitable degrees of myopia, depending on a personal demand.

2. Related Art

As well known, the swimming goggles have developed for a long period of time. Their designs are inseparable from water tightness and wearing comfort. With the raise of consuming independency, the Mix and Match style has become popular, and the conventional swimming goggles should thus change their commodity form as well. In details, the conventional swimming goggles have same form in frame type, color, and specification for both of their lens frames, which cannot effectively meet the growing personalized and emotional demands of consumers. For example, one whose eyes have different degrees of myopia would like to have lenses with different degrees; one who is exposed to the sun or stays indoor without sunshine would like to have the lenses made with different polarizing coefficients; and one who would prefer different colors for both of the lens frames. Therefore, the conventional swimming goggles having a symmetric structure and a unitary type are difficult to satisfy consumers. Accordingly, the above defects exist in the conventional swimming goggles may be solved, as long as a new kind of swimming goggles having the advantages of a variety of structure including freely matched lenses and lens frames is provided to offer consumers with more and better choices to make.

SUMMARY OF THE INVENTION

A main object of the present invention is to provide swimming goggles which bring in convenience in assembly and disassembly thereof, so as to provide wearers to select lens frames by free match for their favorite colors and suitable degrees of myopia, as being a customized assembly.

An another object of the present invention is to provide swimming goggles that is adapted to fit to an outline of a temple of a wearer, so as to provide a wearing comfort and reduce water resistance, and so as to avoid water leakage.

To attain this, swimming goggles in accordance with the present invention comprises a first lens frame, a second lens frame, and a connection element interconnecting the first lens frame and the second lens frame, characterized in that: each of the first lens frame and the second lens frame is composed of a lens portion, a protective pad, and a frame portion, the lens portion comprising a lens, a peripheral surface, a circular groove, a positioning flange, and an embedding groove, the peripheral surface being extended from a periphery of the lens, the circular groove being extended along the peripheral surface, the positioning flange being protruded from the circular groove in a Y-direction; the protective pad comprises a circular body, a face contact circumference disposed at a rear side of the circular body, and a circular lip disposed at a front side of the circular body, an inside wall of the circular body being mounted with a concave groove to receive the positioning flange of the lens portion, the circular lip being inserted in the circular groove of the lens portion; and the frame portion comprises a hard frame body and a soft frame foot, the hard frame body being mounted on the circular lip of the protective pad, an inner side of the hard frame body being disposed with a connection base corresponding to the embedding groove of the lens portion, the connection base being arranged with a connection hole and an embedding slot adjacent to the connection hole, an outer side of the hard frame body being disposed with a connection arm connected with the soft frame foot, the connection arm being disposed with at least a through hole, a free end of the soft frame foot being disposed with a receiving hole to receive a hard head strap buckle.

Accordingly, both ends of the connection element are respectively disposed with a connection pillar, the connection pillar is disposed with a hook body, the hook body has a hook used to be engaged with the embedding slot of the connection hole of the connection base of the hard frame body, and the connection pillar is formed with a slant surface at a backside of the hook.

Accordingly, during the assembling of the swimming goggles, the positioning flange of the lens portion is inserted in the concave groove of the protective pad, while the circular lip of the protective pad is inserted in the circular groove of the lens portion. The hard frame body of the frame portion is then sleeved outside the lens portion through the frame opening, with the connection base of the frame portion being embedded in the embedding groove of the lens portion, to hold the hard frame body of the frame portion against the circular lip of the protective pad. Next, a part of frame opening adjacent to the soft frame foot is inserted in the circular groove of the lens portion, along upper and lower edges of the circular lip. Finally, the connection pillar of the connection element is inserted in the embedding groove of the connection base of the frame portion, with the hook of the connection pillar being embedded in the embedding slot. An assembly of the lens portion, protective pad and frame portion is finished.

Accordingly, during the disassembling of the swimming goggles, the connection element is rotated outward along the slant surface at the backside of the hook of the hook body of the connection pillar to disengage the hook from the embedding slot, so that the connection element is disassembled from the connection hole of the connection base of the frame portion. Next, the soft frame foot of the frame portion is pulled outward to remove an interference with the circular groove. The hard frame body of the frame portion is then pulled outward along upper and lower edges of the frame portion to remove an interference with the circular groove, while the connection base is disengaged from the embedding groove of the lens portion, so that the frame portion is disassembled from the lens portion. Finally, the concave groove of the protective pad is disengaged from the positioning flange of the lens portion, so that the protective pad is disassembled from the lens portion.

Accordingly, the circular body is disposed with a buffer device to absorb an extrusion pressure when the swimming goggles are worn, so as to provide a flexible support and a pressure recovery.

DESCRIPTION OF THE INVENTION

Figure 1:
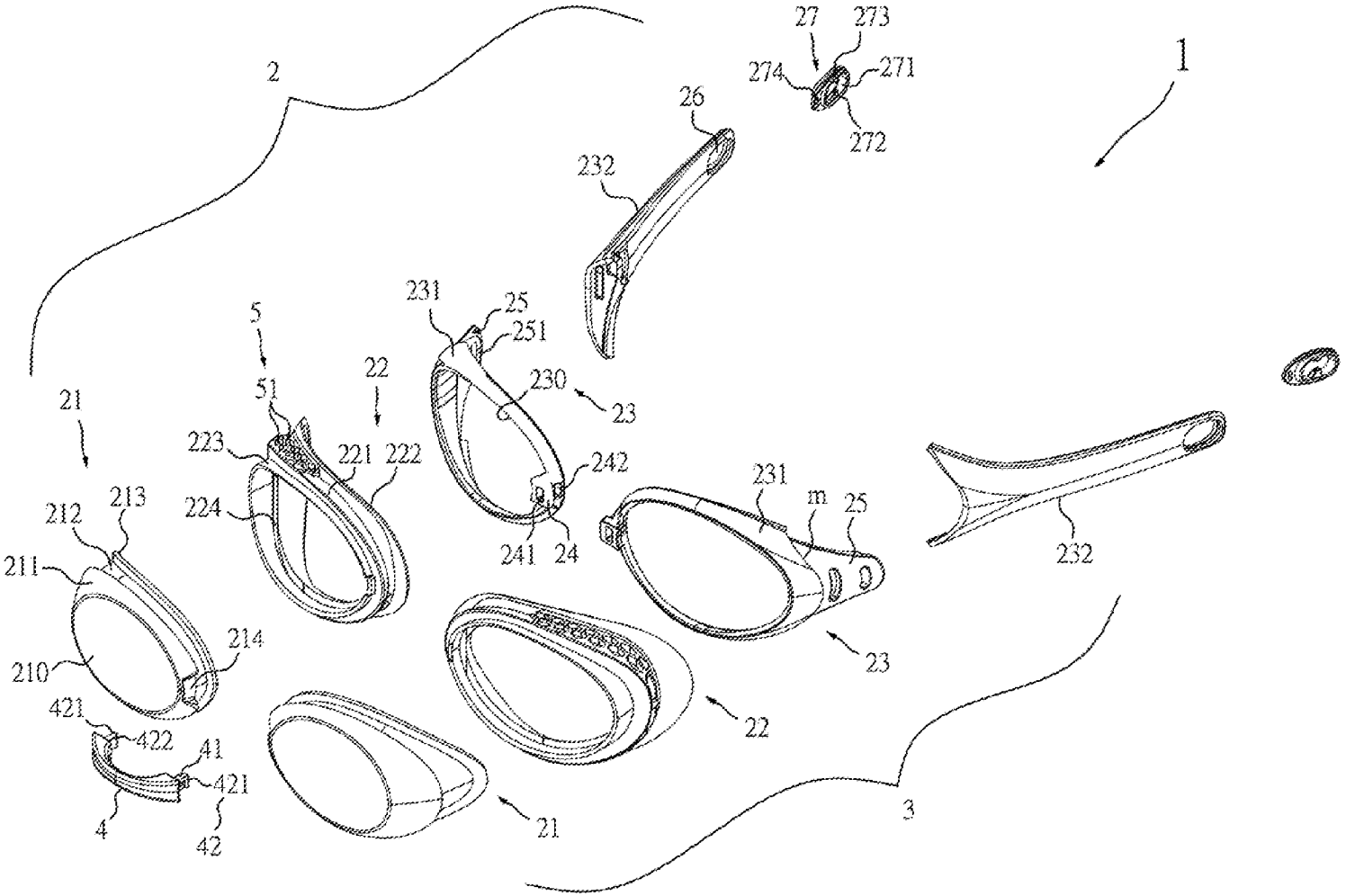
FIG. 1 is an exploded perspective view of the swimming goggles in accordance with the present invention.
Figure 5:
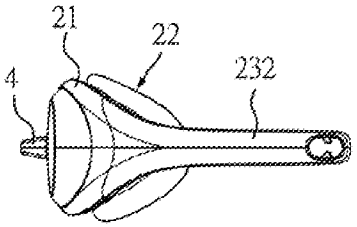
FIG. 5 is a right-side view of FIG. 2.
Figure 3:
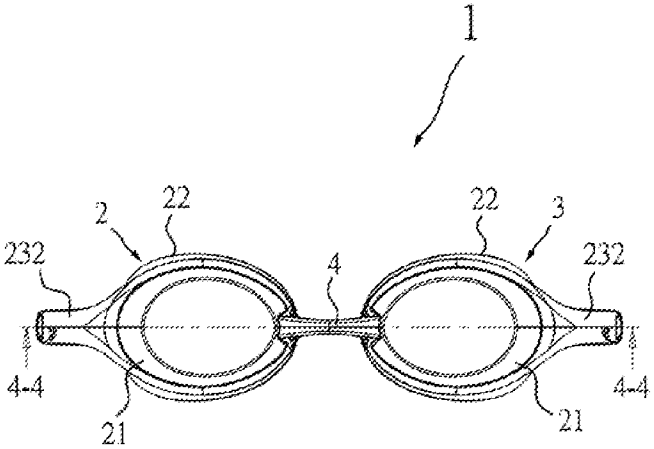
FIG. 3 is a front view of FIG. 2.
Figure 4:
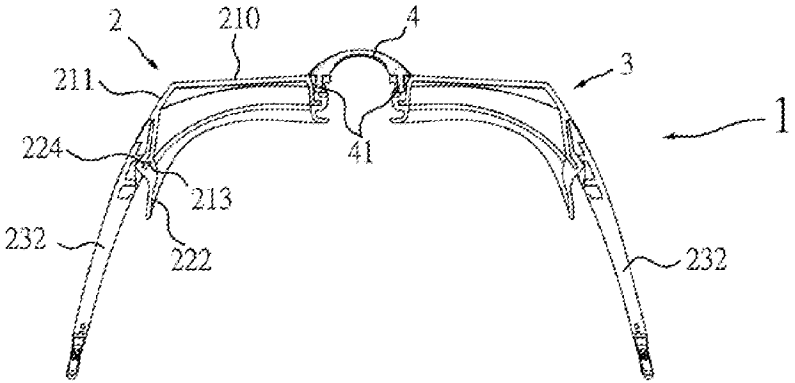
FIG. 4 is a cross-sectional view taken along line 4-4 of FIG. 3.
Figure 2:
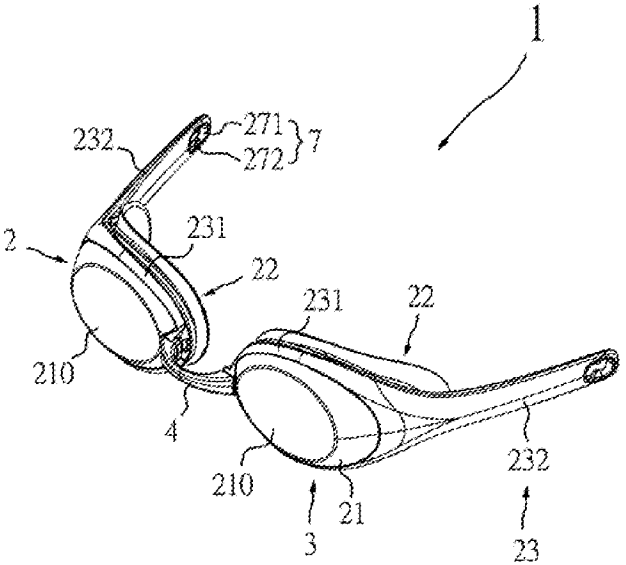
FIG. 2 is an assembled perspective view of FIG. 1.

Referring to FIGS. 1 to 5, swimming goggles 1 in accordance with the present invention comprise a first lens frame 2, a second lens frame 3, and a connection element 4. The connection element 4 interconnects the first lens frame 2 and the second lens frame 3. As shown, the first lens frame 2 and the second lens frame 3 are symmetric structures with exactly same components. To illustrate, only the first lens frame 2 is exemplified as follows. Only partial components of the second lens frame 3 are labeled, as an auxiliary illustration of the first lens frame 2. The first lens frame 2 is composed of a lens portion 21, a protective pad 22, and a frame portion 23. The lens portion 21 comprises a lens 210, a peripheral surface 211, a circular groove 212, a positioning flange 213, and an embedding groove 214. The peripheral surface 211 is extended obliquely from a periphery of the lens 210. An outer corner of the extended peripheral surface 211 is expanded outward as an expansion part with respect to an outer eye corner of a wearer. The circular groove 212 is extended along the peripheral surface 211. The positioning flange 213 is protruded from the circular groove 212 in a Y-direction. The embedding groove 214 is disposed at an inner corner of the extended peripheral surface 211. The protective pad 22 comprises a circular body 221, a face contact circumference 222 disposed at a rear side of the circular body 221, and a circular lip 223 disposed at a front side of the circular body 221. An inside wall of the circular body 221 is mounted with a concave groove 224 to receive the positioning flange 213 of the lens portion 21. The face contact circumference 222 is adapted to contact with a face of the wearer. The circular lip 223 is inserted in the circular groove 212 of the lens portion 21. The circular body 221 is disposed with a buffer device to absorb an extrusion pressure when the swimming goggles 1 are worn, so as to provide a flexible support and a pressure recovery. The buffer device has a plurality of compartments 5 in a continuous and interlaced arrangement spread over the circular body 221. Each of the plurality of compartments 5 has a geometric opening 51 to create a geometric pattern on the circular body 221, such as the geometric pattern of a honeycomb type, an elliptic type, and a rectangular type. The frame portion 23 comprises a hard frame body 231 and a soft frame foot 232. The hard frame body 231 is mounted on the circular lip 223 of the protective pad 22. The hard frame body 231 has a frame opening 230. An inner side of the hard frame body 231 is disposed with a connection base 24 corresponding to the embedding groove 214 of the lens portion 21. The connection base 24 is arranged with a connection hole 241 and an embedding slot 242 adjacent to the connection hole 241. An outer side of the hard frame body 231 is disposed with a connection arm 25 opposite to the connection base 24. Between the connection arm 25 and the hard frame body 231 is formed with a height difference in that benefits to enhance a holding ability of the soft frame foot 232 in molding. The connection arm 25 is disposed with two through holes 251 to provide a basis for holding the soft frame foot 232 in molding. The soft frame foot 232 covers the connection arm 25 and fills up the height difference in in molding, so that the hard frame body 231 is flush with the soft frame foot 232 in appearance after molding. An inner side of the soft frame foot 232 is formed as a smooth face that is adapted to fit to an outline of a temple of the wearer, so as to provide a wearing comfort and reduce water resistance, and so as to avoid water leakage. A free end of the soft frame foot 232 is disposed with a receiving hole 26 to receive a hard head strap buckle 27. The hard head strap buckle 27 is disposed with a guiding hole 271. Two ridges 272,273 are mounted on an inside wall of the guiding hole 271 so as to avoid an entanglement of a head strap in use. The hard head strap buckle 27 is further disposed with a penetrating hole 274 to provide a basis for holding the soft frame foot 232 in molding.

Both ends of the connection element 4 are respectively disposed with a connection pillar 41. The connection pillar 41 is disposed with a hook body 42. The hook body 42 has a hook 421, used to be engaged with the embedding slot 242 of the connection hole 241 of the connection base 24 of the hard frame body 231. The connection pillar 41 is formed with a slant surface 422 at a backside of the hook 421, used to guide the connection element 4 to be disengaged from the connection base 24.

Figure 8:
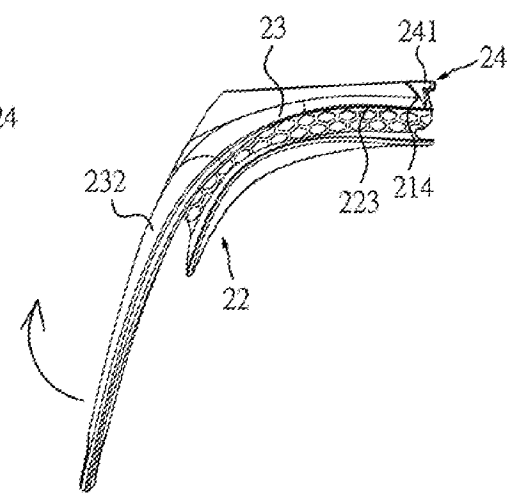
FIGS. 6 to 8 are schematic views showing the swimming goggles of the present invention are assembled.
Figure 7:
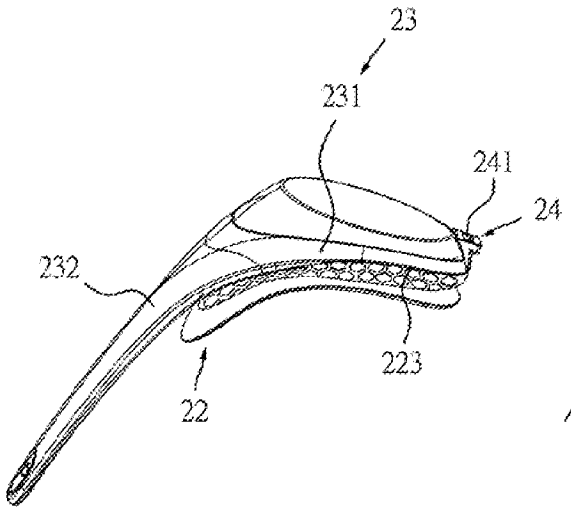
Figure 6:
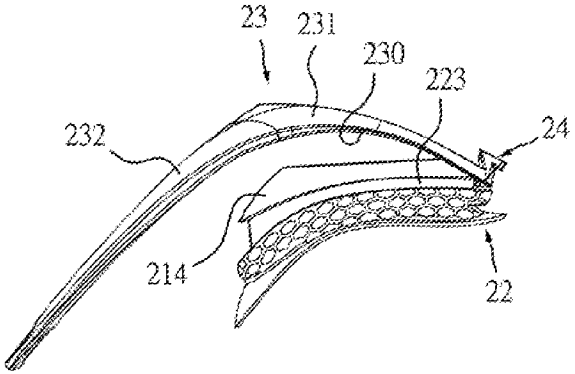
Figure 9:
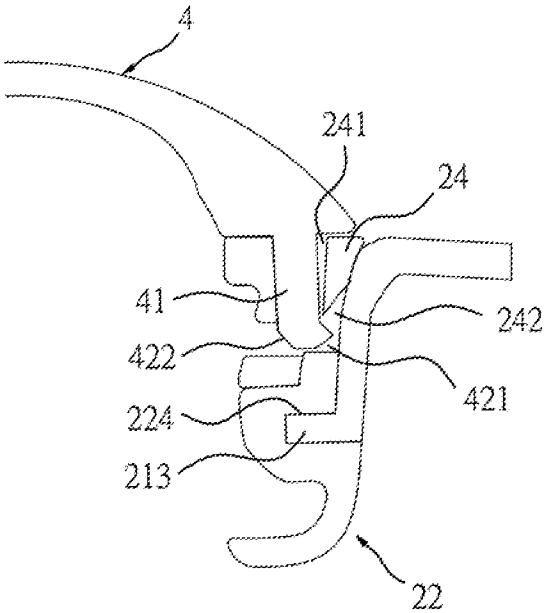

With reference to FIG. 1 in view of FIGS. 6 to 9, during the assembling of the swimming goggles 1, the positioning flange 213 of the lens portion 21 is inserted in the concave groove 224 of the protective pad 22, while the circular lip 223 of the protective pad 22 is inserted in the circular groove 212 of the lens portion 21. The hard frame body 231 of the frame portion 23 is then sleeved outside the lens portion 21 through the frame opening 230, with the connection base 24 of the frame portion 23 being embedded in the embedding groove 214 of the lens portion 21 (FIG. 6), to hold the hard frame body 231 of the frame portion 23 against the circular lip 223 of the protective pad 22. Next, a part of frame opening 230 adjacent to the soft frame foot 232 is inserted in the circular groove 212 of the lens portion 21 (FIG. 8), along upper and lower edges of the circular lip 223 (FIG. 7). Finally, the connection pillar 41 of the connection element 4 is inserted in the embedding groove 241 of the connection base 24 of the frame portion 23, with the hook 421 of the connection pillar 41 being embedded in the embedding slot 242. An assembly of the lens portion 21, protective pad 22 and frame portion 23 is finished (FIG. 9).

Figure 10:
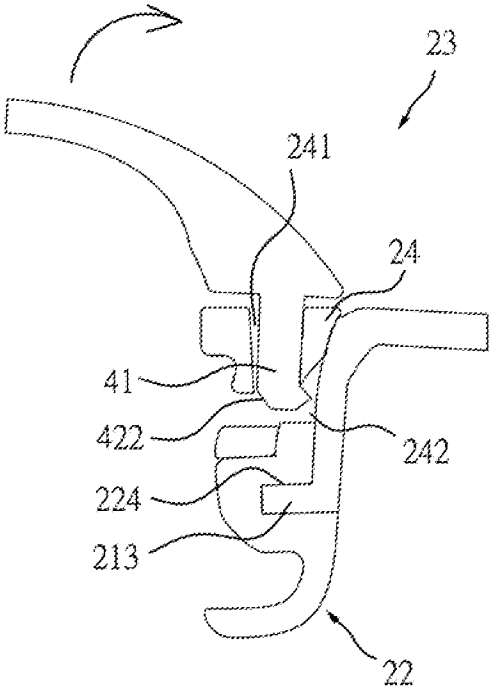
FIGS. 9 and 10 are schematic views showing the engagement and disengagement between a connection element and a connection base of a frame portion in accordance with the present invention.

With reference to FIG. 1 in view of FIGS. 8 to 10, during the disassembling of the swimming goggles 1, the connection element 4 is rotated outward (shown with an arrow in FIG. 10) along the slant surface 422 at the backside of the hook 421 of the hook body 42 of the connection pillar 41 to disengage the hook 421 from the embedding slot 242, so that the connection element 4 is disassembled from the connection hole 241 of the connection base 24 of the frame portion 23. Next, the soft frame foot 232 of the frame portion 23 is pulled outward (shown with an arrow in FIG. 8) to remove an interference with the circular groove 212. The hard frame body 231 of the frame portion 23 is then pulled outward along upper and lower edges of the frame portion 23 to remove an interference with the circular groove 212, while the connection base 24 is disengaged from the embedding groove 214 of the lens portion 21, so that the frame portion 23 is disassembled from the lens portion 21. Finally, the concave groove 224 of the protective pad 22 is disengaged from the positioning flange 213 of the lens portion 21, so that the protective pad 22 is disassembled from the lens portion 21.

Summarized by the above, the swimming goggles 1 provide the connection hole 241, and the embedding slot 242 of the connection base 24 of the frame portion 23, and the embedding groove 214 of the lens portion 21, and the hook 421 of the connection pillar 41 of the connection element 4, so as to provide a convenience in assembly of the lens portion 21, protective pad 22, and frame portion 23 by embedding the hook 421 of the connection pillar 41 into the embedding slot 242, and also to provide a convenience in disassembly thereof by pulling the soft frame foot 232 of the frame portion 23 outward (shown with an arrow in FIG. 8) and by disengaging the frame portion 23 and the protective pad 22. Therefore, either assembly or disassembly thereof is very fast and convenient. And by virtue of the geometric opening 51 of the plurality of compartments 5 on the protective pad 22, the swimming goggles 1 can be assembled by free match between options, depending on the personal demand, and provide a wearing comfort and a preferable protective effect.

It is understood that the invention may be embodied in other forms within the scope of the claims. Thus the present examples and embodiments are to be considered in all respects as illustrative, and not restrictive, of the invention defined by the claims.

What is claimed is:

1. Swimming goggles, comprising a first lens frame, a second lens frame, and a connection element interconnecting the first lens frame and the second lens frame, characterized in that:

each of the first lens frame and the second lens frame is composed of a lens portion, a protective pad, and a frame portion, the lens portion comprising a lens, a peripheral surface, a circular groove, and a positioning flange, the peripheral surface being extended from a periphery of the lens, the circular groove being extended along the peripheral surface, the positioning flange being protruded from the circular groove in a Y-direction;

the protective pad comprises a circular body, a face contact circumference disposed at a rear side of the circular body, and a circular lip disposed at a front side of the circular body, an inside wall of the circular body being mounted with a concave groove to receive the positioning flange of the lens portion, the circular lip being inserted in the circular groove of the lens portion; and the frame portion comprises a hard frame body and a soft frame foot, the hard frame body being mounted on the circular lip of the protective pad, an outer side of the hard frame body being disposed with a connection arm connected with the soft frame foot, the connection arm being disposed with at least a through hole, a free end of the soft frame foot being disposed with a receiving hole to receive a hard head strap buckle, the hard head strap buckle being disposed with a guiding hole;

wherein the first lens frame is connected with the second lens frame, wherein an embedding groove is disposed at an inner corner of the extended peripheral surface, an inner side of the hard frame body is disposed with a connection base corresponding to the embedding groove of the lens portion, the connection base is arranged with a connection hole and an embedding slot adjacent to the connection hole, both ends of the connection element are respectively disposed with a connection pillar, the connection pillar is disposed with a hook body, and the hook body has a hook used to be engaged with the embedding slot of the connection hole of the connection base of the hard frame body.

2. The swimming goggles of claim 1, wherein a height difference is formed between the connection arm and the hard frame body.

3. The swimming goggles of claim 2, wherein the soft frame foot covers the connection arm and fills up the height difference, so that the hard frame body is flush with the soft frame foot in appearance.

4. The swimming goggles of claim 3, wherein an inner side of the soft frame foot is formed as a smooth face that is adapted to fit to an outline of a temple of the wearer, to provide a wearing comfort.

5. The swimming goggles of claim 1, wherein the hard head strap buckle is disposed with a penetrating hole to provide a basis for holding the soft frame foot in molding.

6. The swimming goggles of claim 1, wherein at least a ridge is mounted on an inside wall of the guiding hole.

7. The swimming goggles of claim 1, wherein the connection pillar is formed with a slant surface at a backside of the hook.

8. The swimming goggles of claim 1, wherein the circular body is disposed with a buffer device to absorb an extrusion pressure when the swimming goggles are worn, so as to provide a flexible support and a pressure recovery, wherein the buffer device has a plurality of compartments in a continuous and interlaced arrangement spread over the circular body, and each of the plurality of compartments has a geometric opening to create a geometric pattern on the circular body, such as the geometric pattern of a honeycomb type, an elliptic type, and a rectangular type.

9. The swimming goggles of claim 1, wherein the peripheral surface of the lens portion is extended obliquely from the periphery of the lens, and an outer corner of the extended peripheral surface is expanded outward as an expansion part with respect to an outer eye corner of the wearer.

* * * * *